US007201961B2

(12) United States Patent
Narimatsu et al.

(10) Patent No.: US 7,201,961 B2
(45) Date of Patent: Apr. 10, 2007

(54) COATING FILM TAPE END STRUCTURE

(75) Inventors: Kenichi Narimatsu, Osaka (JP); Hideki Tanaka, Osaka (JP)

(73) Assignee: Fujicopian Co., Ltd., Osaka-shi (JP)

( * ) Notice: Subject to any disclaimer, the term of this patent is extended or adjusted under 35 U.S.C. 154(b) by 0 days.

(21) Appl. No.: 11/181,127

(22) Filed: Jul. 14, 2005

(65) Prior Publication Data

US 2006/0003161 A1 Jan. 5, 2006

(51) Int. Cl.

| | |
|---|---|
| ***B32B 7/12*** | (2006.01) |
| ***B32B 15/04*** | (2006.01) |
| ***B65H 37/00*** | (2006.01) |
| ***B44C 7/00*** | (2006.01) |

(52) U.S. Cl. ..... 428/343; 428/354; 156/540; 156/577

(58) Field of Classification Search ..... 428/343, 428/354

See application file for complete search history.

(56) References Cited

FOREIGN PATENT DOCUMENTS

JP 6-115229 4/1994
JP 06171190 A * 6/1994
JP 2006015621 A * 1/2006

OTHER PUBLICATIONS

Computer translation of JP 06-171190, see above for inventor and date.*
Computer translation of JP 06-115229, see IDS file Jul. 14, 2005 for inventor and date.*
Machine translation of JP 2006015621A, see above for invenor and date.*

* cited by examiner

*Primary Examiner*—Victor Chang
(74) *Attorney, Agent, or Firm*—Howson & Howson LLP

(57) ABSTRACT

In a the structure of end tape for revealing impending exhausting of a coating film tape supply, the end tape is connected to the core by a first single-sided adhesive tape, and to the coating film tape by a second single-sided adhesive tape, both adhesive tapes having a thickness of not more than 25μ. The thickness of the second single-sided adhesive tape is 20% to 70% of the total thickness of the adhered section where the second single-sided adhesive tape, the end tape and the coating film tape overlap, and at least 30% of the thickness of the adhered section where the second adhesive tape is adhered directly to the coating film tape. The thickness of the first adhesive tape is 30% to 70% of the total thickness of the adhered section, where the first adhesive tape and the end tape overlap.

1 Claim, 2 Drawing Sheets

COATING FILM TAPE END STRUCTURE

FIELD OF THE INVENTION

This invention relates to coating film tapes, and more particularly to the structure of a coating film end tape, that is a short length of tape, having an appearance different from that of a film-coated tape, provided for the purpose of revealing the impending exhaustion of the tape supply.

BACKGROUND OF THE INVENTION

A coating film transfer tool is used for transferring a correction film for correction, an adhesive, a decorative coating film, or the like onto a receiving surface. The transfer tool usually employs a coating film tape comprising a layer of coating film layer on a base material.

In order to notify the user when the tape supply in the transfer tool is nearly exhausted, a contrasting length of tape, referred to as an "end tape," is provided at the end of the coating film tape. The end tape, which is typically composed of a material such as polyester, is connected between a core and the coating film tape. An example of such a structure is disclosed in unexamined Japanese Patent Publication No. 115229/1994.

The core is adhered to the end tape, and the end tape is adhered to the coating film tape, using short lengths of single-sided adhesive tape. The locations along the lengths of the coating film tape and the end tape where the adhesive tape overlaps one or both tapes are referred to as "adhered sections." These adhered sections have different thicknesses. For example, where the end tape is connected to the core, the thickness of the adhered section is the sum of the thicknesses of the end tape and the adhesive tape. Where the end tape is connected to the coating film tape, there are two adhered sections, one having a thickness which is the sum of the thicknesses of the coating film tape and the adhesive tape, and the other having a thickness which is the sum of the thickness of the adhesive tape and overlapping portions of the end tape and the coating film tape.

When the coating film tape wound onto a core, the outer windings exert a radial inward pressure on the inner windings. This pressure, referred to herein as "winding pressure," is concentrated on the adhered sections, due to their uneven thickness. The concentration of winding pressure causes the coating film to become exfoliated from the base material of the coating film tape, and also causes the coating film adhere to the back surface of the base material of an adjacent winding of coating film tape. These conditions cause several problems. First, they can cause uneven transfer of the coating film onto a receiving surface. Second, accumulation, at the tip of the transfer head, of coating film adhering to the back of the coating film base material, causes failure of the tip to exert even pressure against the receiving surface. Third, adhesion of the coating film to the back of an adjacent winding results in resistance to rotation of the reel of transfer tape, making film transfer difficult.

Where the thickness of the single-sided tape is about 60 microns, the above-mentioned problems can be avoided by using a coating film tape with a thickness of 38 microns. However, when the coating film tape is made thinner in order to miniaturize the coating film transfer tool, the resiliency and tensile strength of the base material of the tape are weakened, and detachment of the coating film can occur easily. Furthermore, when the diameter of the core is reduced, the winding pressure tends to become concentrated. Consequently, when a thinner coating film tape is used, the detachment problem becomes more severe.

SUMMARY OF THE INVENTION

The principal object of this invention is to provide a coating film end tape structure that prevents the coating film from partly detaching or exfoliating from the base material of the tape, even when a thin coating film tape is used.

The coating film end tape structure according to the invention comprises a core, a coating film tape, an end tape, and two single-sided adhesive tapes respectively connecting the end tape to the core and connecting the coating film tape to the end tape.

A first of the single-sided adhesive tapes adheres to the core and overlaps the end tape at a location adjacent one end of the end tape, thereby connecting the end tape to the core. These overlapping parts of the end tape and the first adhesive tape constitute a first adhered section having a thickness equal to the sum of the thicknesses of the adhesive tape and the end tape. The coating film tape overlaps the end tape at a location adjacent the opposite end of the end tape, and the second adhesive tape overlaps, and adheres to, one of the end tape and the coating film tape at the location of the overlapping parts of the coating film tape and the end tape.

Thus, at this location, there are three overlapping parts: the end tape, the coating film tape and the second single-sided adhesive tape. These three overlapping parts form a second adhered section having a thickness equal to the sum of the thicknesses of the end tape, the coating film tape and the second adhesive tape.

The second adhesive tape also adheres to the other of the coating film tape and the end tape at a location adjacent the second adhered section to form a third adhered section having a thickness equal to the sum of the thicknesses of the second adhesive tape and said other of the coating film tape and the end tape.

The thickness of each of the adhesive tapes is not greater than 25 microns. The thickness of the first adhesive tape is from 30% to 70% of the thickness of the first adhered section, and the thickness of the second adhesive tape is from 20% to 70% of the thickness of the second adhered section and at least 30% of the thickness of the third adhered section.

In the end tape structure according to the invention, the winding pressure exerted by outer turns of the tape is not concentrated at the adhered sections described above, even though a thin coating film tape is employed. Therefore, the coating film is prevented from exfoliating from the base material of the coating film tape, accumulation of coating film material at the tip of the transfer head is avoided, the tape unrolls smoothly from the tape supply reel, and neat and uniform transfer of the coating film is achieved.

DETAILED DESCRIPTION OF THE PREFERRED EMBODIMENTS

Figure 1:
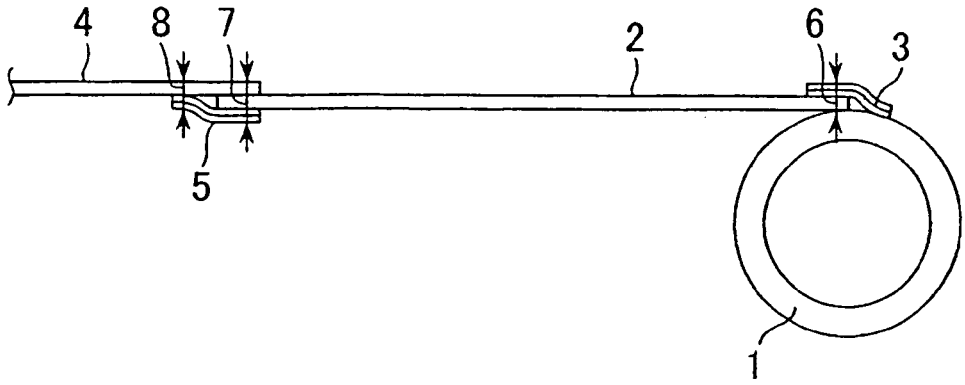
FIG. 1 is a side elevational view of a coating film end tape structure in accordance with the invention.

As shown in FIG. 1, a coating film transfer tape 4 is connected to a core 1 by a length of end tape 2, which has an appearance different from that of the coating film tape.

The end tape 2 is connected to the core by a first short length of single-sided adhesive tape 3, a part of which adheres to the outer surface of the core 1, and another part of which overlaps and adheres to the end tape 2 at a location adjacent one end of the end tape 2. The overlapping parts of end tape 2 and adhesive tape 3 constitute a first adhered section having a thickness 6, equal to the sum of the thicknesses of the adhesive tape and the end tape. The other end of the end tape 2 overlaps the coating film tape 4 and is connected to the coating film tape by a second short length of single-sided adhesive tape 5. A part of tape 5 adheres directly to the uncoated side of the base material of the coating film tape 4, and another part of tape 5 adheres to the end tape at the location at which the end tape and the coating film tape overlap. Thus, the adhered parts of the second adhesive tape 5 and the end tape 2, together with the part of the coating film tape 4 which overlaps the end tape 2 form a second adhered section having a thickness 7, equal to the sum of the thicknesses of the adhesive tape 5, the coating film tape 4 and the end tape 2. The adhered parts of the adhesive tape 5 and the coating film tape 4 constitute a third adhered section, having a thickness 8 equal to the sum of the thicknesses of the adhesive tape 5 and the coating film tape 4.

For miniaturization of the coating film transfer tool, the coating film tape 4 is preferably made thinner than conventional coating film tape, which typically has a thickness of 38 microns. In a preferred embodiment of the invention, the thickness of the coating film tape is about 28 microns, and the thickness of the end tape 2 is preferably in the range from about 12 to 25 microns.

Figure 2:
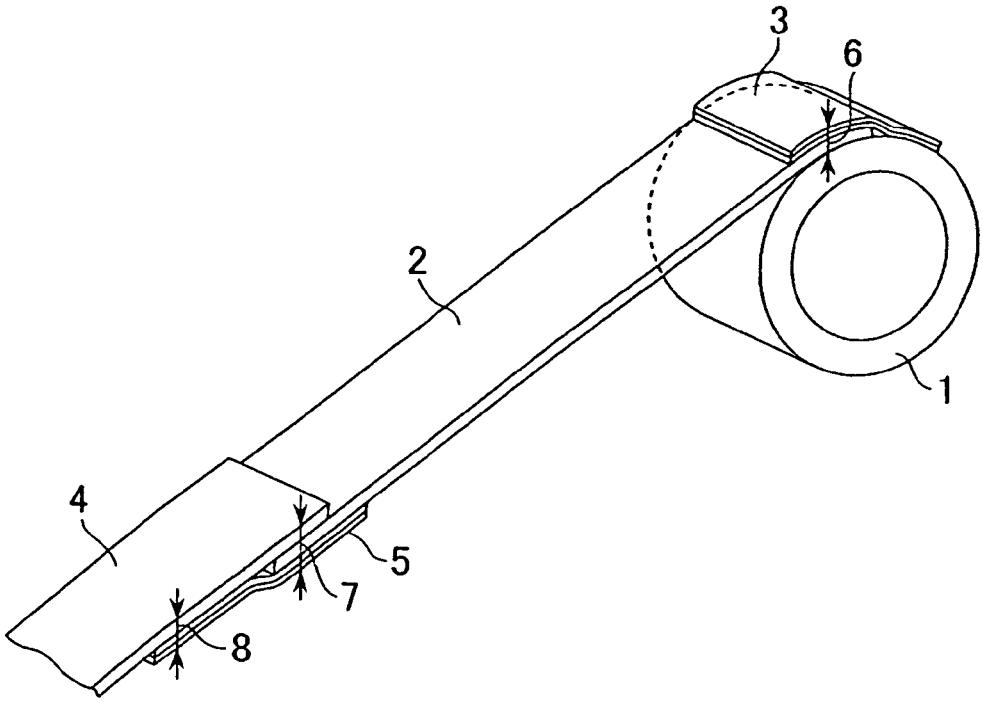
FIG. 2 is a perspective view of the coating film end tape structure of FIG. 1.

As shown in FIGS. 1 and 2, each of the first and third adhered sections, having thicknesses 6 and 8, respectively, comprises two layers of tape, while the second adhered section, having a thickness 7, comprises three layers of tape. Thus, each of the three adhered sections is thicker than other sections of the coating film tape. If conventional single-sided adhesive tape, having a thickness of 60 microns is used, and the conventional coating film tape is wound into a roll, the uneven thickness of the adhered sections would cause winding pressure would be concentrated on the adhered sections.

The invention provides for a more even tensile force on the coating film tape by reducing the thickness of the three adhered sections. To this end, the thicknesses of both of the single-sided adhesive tapes is reduced from conventional thickness of 60 microns to a thickness of not more than 25 microns.

The ratio of the thickness of the second single-sided adhesive tape 5 to the total thickness 7 of the second adhered section, where the adhesive tape 5, the end tape 2 and the coating film tape 4 overlap, should be in the range from 20% to 70%. In addition, the ratio of the thickness of the first single-sided adhesive tape 3 to the total thickness 6 of the first adhered section 6, where the end tape 2, and the first adhesive tape 3 overlap, is preferably in the range of 30% to 70% of the total thickness 6 of the first adhered section. The ratio of the thickness of the second adhesive tape 5 to the thickness 8 of the third adhered section where the adhesive tape 5 and the coating film tape 4 overlap, is preferably also at least 30%. When the thicknesses of the adhesive tapes are below the above-mentioned lower limits (20% in the case of the second adhered section, and 30% in the case of the first and third adhered sections, the connection of the coating film tape to the end tape and the connection of the end tape to the core can come apart, resulting in operational failure of the coating film transfer tool.

In a first example of the invention, a coating film tape, having a thickness of 28 microns, including the base material (a PET film having a thickness 6 microns), was connected to a core having an outside diameter of 0.6 cm, using a polyester end tape having a thickness of 12 microns and first and the second single-sided adhesive tapes, each having a thickness of 25 microns.

In a second example, the same coating film and end tapes as those of the first example were used. However, the thicknesses of the single-sided adhesive tapes were 15 microns instead of 25 microns.

In a first comparative example 1, the same coating film and end tapes as those of the first and second examples were used. The single-sided adhesive tapes, however, had a thickness of 60 microns.

In a second comparative example 1, the same coating film and end tapes as those of the first and second examples, an the first comparative example, were used. The single-sided adhesive tapes, however, had a thickness of 50 microns. Comparative Example 2.

Tape-running test of coating film transfer tools having tape structures according to the above examples were carried out. Performance was evaluated by visual observation of detachment or exfoliation of the coating film from the coating film tape. Performance was considered satisfactory if exfoliation of the coating film could not be seen with the naked eye.

| Example | Thickness of single-sided adhesive tape | Visible exfoliation from 28μ coating film tape |
|---|---|---|
| First | 25μ | No |
| Second | 15μ | No |
| First Comparative | 60μ | Yes |
| Second comparative | 50μ | Yes |

As shown in the above table, when the thickness of the single-sided adhesive tape is 25 microns or less, the coating film does not detach, even when the thickness of the coating film tape is 28 microns. Reduction of the thicknesses 6, 7 and 8 of the of the adhered sections prevented concentration of winding pressure onto the adhered sections, and produced favorable results due to the more even tensile force exerted on the tape during operation of the coating film tool. On the other hand, when the thickness of the single-sided adhesive tape was 50 or 60 microns, the uneven thickness of the adhered sections resulted in detachment of the coating film.

To avoid having the adhered sections on top of one another at the same circumferential location, the length of the end tape should not be an integer multiple of the circumference of the core 1.

Figure 3:
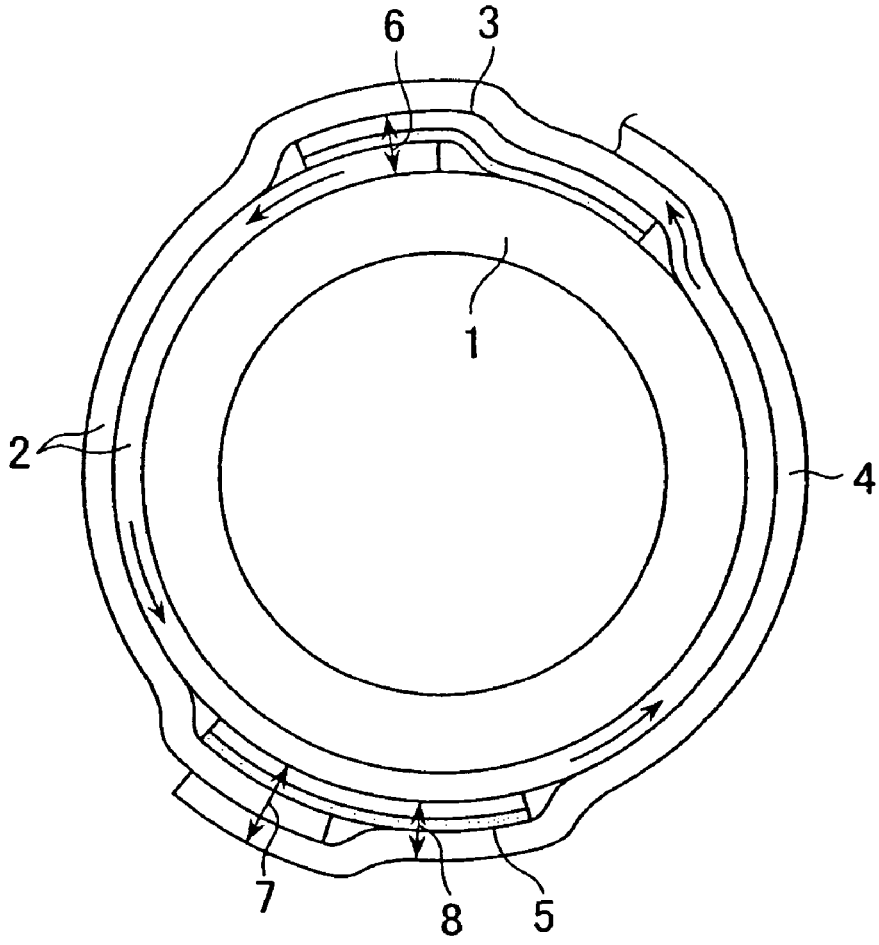
FIG. 3 is a side elevational view of a tape reel with the coating film tape wound around a core and connected to the core by an end tape in accordance with the invention.

While the invention has been described by reference to preferred examples, various modifications can be made. For example, although it is preferable to overlap tapes 2 and 4 so that tape 2 is on the inside at and tape 4 is on the outside, at the second adhered section (having thickness 7) as shown in FIG. 3, it is possible to overlap tapes 2 and 4 so that tape 2 is on the outside and tape 4 is on the inside. Various other modifications can be made to the embodiments described without departing from the scope of the invention as defined in the claims.

What is claimed is:

1. A coating film end tape structure comprising:

a core;

and end tape having opposite first and second ends;

a first single-sided adhesive tape adhered to the core, overlapping the end tape at a location adjacent the first end of the end tape, and connecting the end tape to the core, said first end of the end tape being disposed between the first single-sided adhesive tape and the core so that an adhesive layer on the single-sided adhesive tape adheres to an outside face of the end tape when the end tape is wound on the core, and the overlapping parts of the end tape and the first adhesive tape constituting a first adhered section having a thickness equal to the sum of the thicknesses of the adhesive tape and the end tape;

a coating film tape, the coating film tape overlapping the end tape at a location adjacent the second end of the end tape; and a second single-sided adhesive tape overlapping, and adhered to, one of the end tape and the coating film tape at the location of the overlapping parts of the coating film tape and the end tape, the overlapping parts of the end tape, the coating film tape and the second single-sided adhesive tape forming a second adhered section having a thickness equal to the sum of the thicknesses of the end tape, the coating film tape and the second adhesive tape, the second adhesive tape being also adhered to the other of the coating film tape and the end tape at a location adjacent the overlapping parts of the coating film tape and the end tape, whereby the overlapping parts of the second adhesive tape and said other of the coating film tape and the end tape constitute a third adhered section having a thickness equal to the sum of the thicknesses of the second adhesive tape and said other of the coating film tape and the end tape, an adhesive layer on the second single-sided adhesive tape adhering to inside faces of the coating film tape and the end tape when the coating film tape and end tape are wound on the core; in which the thickness of each of the adhesive tapes is not greater than 25 microns;

the thickness of the first adhesive tape is from 30% to 70% of the thickness of the first adhered section; and the thickness of the second adhesive tape is from 20% to 70% of the thickness of the second adhered section and at least 30% of the thickness of the third adhered section.

* * * * *